US007686005B2

(12) United States Patent
Adams

(10) Patent No.: US 7,686,005 B2
(45) Date of Patent: Mar. 30, 2010

(54) COMBUSTION-GAS-POWERED PAINTBALL MARKER

(76) Inventor: Joseph S. Adams, 481 Beaver Point Road, Salt Spring Island, British Columbia (CA) V8K 2J9

( * ) Notice: Subject to any disclaimer, the term of this patent is extended or adjusted under 35 U.S.C. 154(b) by 0 days.

(21) Appl. No.: 11/714,168

(22) Filed: Mar. 6, 2007

(65) Prior Publication Data

US 2007/0175324 A1 Aug. 2, 2007

Related U.S. Application Data

(62) Division of application No. 10/760,922, filed on Jan. 20, 2004.

(60) Provisional application No. 60/443,520, filed on Jan. 29, 2003.

(51) Int. Cl.
*F41B 11/00* (2006.01)
*F41A 1/04* (2006.01)

(52) U.S. Cl. ..... 124/77; 89/7

(58) Field of Classification Search ..... 89/7; 124/71–77

See application file for complete search history.

(56) References Cited

U.S. PATENT DOCUMENTS 1,375,653 A * 4/1921 McLain et al. ..... 89/1.1
1,463,518 A 7/1923 Thomas
1,653,171 A * 12/1927 Hagen ..... 89/1.1
2,091,672 A 8/1937 Cleereman
2,362,075 A 11/1944 Keahey, Jr.
2,391,636 A 12/1945 McArthur
2,822,732 A 2/1958 Laidler
3,380,345 A 4/1968 Emmet
3,503,299 A 3/1970 Billingslea et al.
3,951,038 A 4/1976 Van Langenhoven
4,043,248 A 8/1977 Bulman et al.
4,100,836 A 7/1978 Hofmann
4,377,991 A 3/1983 Liesse
4,603,615 A 8/1986 Ashley
4,616,622 A 10/1986 Milliman
4,665,868 A 5/1987 Adams
RE32,452 E 7/1987 Nikolich
4,745,841 A 5/1988 Magoon et al.
4,759,318 A 7/1988 Adams
4,821,683 A 4/1989 Veldman
4,850,330 A * 7/1989 Nagayoshi ..... 124/76
4,905,634 A 3/1990 Veldman
5,000,128 A 3/1991 Veldman
5,063,826 A 11/1991 Bulman (Continued)

FOREIGN PATENT DOCUMENTS

JP 60104806 6/1985

(Continued)

*Primary Examiner*—Troy Chambers
(74) *Attorney, Agent, or Firm*—Law Offices of Steven W. Weinrieb

(57) ABSTRACT

An onboard combustion-gas-powered engine supplies power to a paintball marker or other projectile launcher by generating gas pressure pulses for propelling paintballs and other projectiles. The combustion gases produced by the engine can be allowed to rise in pressure within a confined volume of space before being released through a valve into a barrel for applying enhanced pressure pulses to the projectiles. A loading system is linked to a combustion accelerating system for automatically loading projectiles into the launcher.

10 Claims, 13 Drawing Sheets

U.S. PATENT DOCUMENTS

| | | | | |
|---|---|---|---|---|
| 5,125,320 | A | 6/1992 | Zielinski | |
| 5,199,626 | A | 4/1993 | Terayama et al. | |
| 5,257,614 | A | 11/1993 | Sullivan | |
| 5,333,594 | A | 8/1994 | Robinson | |
| 5,398,591 | A | 3/1995 | Gay | |
| 5,499,567 | A | 3/1996 | Gay | |
| 5,540,194 | A | 7/1996 | Adams | |
| 5,613,483 | A | 3/1997 | Lukas et al. | |
| 5,715,803 | A * | 2/1998 | Mattern | 124/70 |
| 5,769,066 | A | 6/1998 | Schneider | |
| 5,771,621 | A | 6/1998 | Rogers | |
| 5,771,875 | A | 6/1998 | Sullivan | |
| 5,967,133 | A | 10/1999 | Gardner et al. | |
| 6,003,504 | A | 12/1999 | Rice et al. | |
| 6,138,656 | A | 10/2000 | Rice et al. | |
| 6,212,988 | B1 | 4/2001 | Chernyshov et al. | |
| 6,233,928 | B1 | 5/2001 | Scott | |
| 6,343,599 | B1 | 2/2002 | Perrone | |
| 6,371,099 | B1 | 4/2002 | Lee | |
| 6,418,920 | B1 | 7/2002 | Marr | |
| 6,474,326 | B1 | 11/2002 | Smith et al. | |
| 6,491,002 | B1 | 12/2002 | Adams | |
| 6,634,325 | B1 | 10/2003 | Adams | |
| 6,647,969 | B1 | 11/2003 | Adams | |
| 2002/0088449 | A1 | 7/2002 | Perrone | |
| 2003/0005918 | A1 | 1/2003 | Jones | |
| 2003/0110758 | A1 | 6/2003 | Adams | |
| 2003/0131809 | A1 | 7/2003 | Adams | |
| 2006/0032487 | A1 * | 2/2006 | Tippmann et al. | 124/74 |

FOREIGN PATENT DOCUMENTS

| | | |
|---|---|---|
| JP | 4136696 | 5/1992 |
| JP | 5215492 | 8/1993 |
| JP | 6185894 | 7/1994 |

* cited by examiner

COMBUSTION-GAS-POWERED PAINTBALL MARKER

CROSS-REFERENCE TO RELATED APPLICATIONS

This patent application is a Divisional patent application of prior U.S. patent application Ser. No. 10/760,922, which was filed on Jan. 20, 2004.

Priority is claimed to Provisional Application No. 60/443,520, filed 29 Jan. 2003, the disclosure of which is hereby incorporated by reference.

BACKGROUND OF INVENTION

1. Field of the Invention

Propulsion systems of paintball markers generally provide for discharging gas pressure pulses for propelling paintballs. Such pressure pulses in accordance with this invention are produced by gas-powered engines. Similar propulsion systems can be applied to other projectile launchers such as air guns, air soft guns, simmunitions, training guns, as well as other fuel cell powered launchers.

2. Description of Related Art

Conventional paintball markers include pneumatic launching systems powered by portable supplies of compressed gas, such as $CO_2$, air, or nitrogen, mounted directly on the markers or connected to the markers through a short supply line. Metered amounts of the compressed gas are released from the portable supplies into the markers for propelling individual paintballs from the markers. The paintballs themselves are typically 0.68 caliber balls constructed with a gelatinous or gelatin-like outer skin and a liquid-filled center of paint or other marking material. Paintball markers are used for such purposes as marking trees and livestock, as well as for the sport of paintball. Paintball markers are also used in police and military training exercises.

A number of problems are associated with the practice of deriving gas pressure pulses from portable supplies of compressed gas as well as with the practice of transporting compressed gas supplies. For example, some markers are adapted to receive small 12-gram $CO_2$ cartridges to limit the size and weight of the markers. However, the limited amount of compressed gas severely restricts the number of shots (pressure pulses) that can be fired from the markers to a level that is not acceptable to most users. Consequently, most users carry a large heavy-walled container resembling a fire extinguisher to have a sufficient supply of gas pressure to support the number of shots required for a typical exercise.

In addition to the difficulty and inconvenience of transporting large containers, the transport of high-pressure containers, particularly large high-pressure containers, poses significant safety concerns. Typical gas pressures range from 700 psi (pounds per square inch) to 4000 psi, and such high-pressure containers are potentially very dangerous and must be handled carefully to avoid accidents.

The reliability of gas pressure containers is also a concern. The propulsive force produced by these high-pressure containers can vary depending upon conditions of temperature, the remaining pressure in the gas container, and the rate of use.

BRIEF SUMMARY OF INVENTION

My invention provides among its various embodiments an improved propulsion system for paintball markers and other projectile launchers. In place of a supply of compressed gas, which is the conventional source of propulsive force for paintball markers, my invention produces gas pressure pulses from an onboard engine. Conventional $CO_2$ cartridges or other onboard supplies of compressed gas can be replaced by a much smaller supply of fuel, which is metered and mixed with ambient air in the presence of a spark for generating pressure pulses by combustion. The onboard engine can be arranged in accordance with my invention to produce a rapid succession of pressure pulses having a consistent pressure pulse profile. Adjustments can also be made for adapting the profiles of the pressure pulses to desired conditions or objectives of use.

Thus, instead of drawing from a diminishing supply of compressed gas to propel paintballs, my invention generates its own onboard gas pressure pulses. The gas pressure pulses generated by my preferred gas-powered combustion engine can be produced more consistently and can be shaped as they are generated to optimally accelerate a paintball from a paintball marker. The gas pressure pulses are preferably formed directly from the combustion gases of the engine or can also be formed indirectly by converting the gas pressure pulses produced from the combustion gases into corresponding gas pressure pulses in non-combustion (e.g., ambient) air. Preferably, the pressure profile of the combustion gases themselves is shaped to directly apply a gas pressure pulse to a paintball. A small volume of ambient air preferably separates the paintball from the combustion chamber to moderate and cool the combustion gases in advance of their contact with the paintball. Alternatively, the combustion gases can be used to drive a pump that compresses non-combustion (e.g., ambient) air behind a paintball. The onboard engine drives the pump, and both cooperate to shape the gas pressure pulse reaching the paintball.

A preferred paintball marker in accordance with my invention is powered by an engine that generates combustion gases that are transmitted directly to paintballs. The combustion gases are preferably directed in the form of gas pressure pulses from a combustion chamber into a barrel for propelling individual paintballs. Combustion gas pressure can be allowed to rise within a confined volume of space before being released through a valve into the barrel for applying enhanced pressure pulses to the paintballs.

For producing gas pressure pulses of sufficient energy within a gas-powered engine of limited dimensions, the engine preferably includes a combustion accelerating system for increasing the burn rate of combustion gases. The combustion accelerating system is preferably located within a cylinder head and includes a displacer such as a mixing piston that redistributes space between a mixing chamber and a combustion chamber. Movement of the mixing piston in a first direction draws air into the mixing chamber and displaces exhaust gases from the combustion chamber. Movement of the mixing piston in a second direction transfers a charge of fuel and air from the mixing chamber into the combustion chamber for producing a turbulent charge in the combustion chamber. Combustion within the combustion chamber is accelerated by the turbulence, allowing for the generation of a high peak pressure over a short time sufficient for propelling a paintball. A check valve can be used to prevent any return flows from the combustion chamber into the mixing chamber.

The ignition of the turbulent fuel and air charge can be timed with movement of the mixing piston in the second direction to further regulate the output power of the engine. For example, as the mixing piston approaches a far end of the mixing chamber (i.e., where the mixing chamber is collapsed), the mixing piston can contact a switch that is coupled to an ignition system for igniting the fuel and air mixture in the combustion chamber. The timing of the ignition in relation to the movement of the mixing piston can be adjusted for changing the output power of the engine. The movement of the mixing piston produces only a short period of high turbulence within the combustion chamber before the swirling mixture slows down. Output power decreases with decreasing turbulence. Accordingly, a delay can be incorporated into the ignition system for the purpose of adjusting the output power of the engine to moderate the output velocity of the paintball.

An actuating system can be used for moving the mixing piston in opposite directions. For example, a biasing mechanism such a return spring or a manual actuator can be used to move the mixing piston in the first direction for drawing in fresh air and displacing exhaust gases. A rechargeable source of potential energy, such as a main spring, can be used to accelerate the mixing piston in the second direction for producing the desired turbulence in the combustion chamber. A resettable actuator can be used to recharge the source of potential energy (e.g., compress the main spring) either manually, such as by use of a manual actuator, or automatically, such as by use of excess combustion pressure.

A manual resettable actuator can take the form of a starting handle that manually restores the main spring of the rechargeable source to an initial latched position separately or together with the mixing piston. That is, the same manual actuator can be used both for restoring the main spring of the rechargeable source and for moving the mixing piston in the first direction, or the manual actuator can be used only to restore the main spring while the return spring of the biasing mechanism moves the mixing piston in the first direction. When released by a trigger, the main spring drives the mixing piston in the second direction for transferring a charge of fuel and air from the mixing chamber into the combustion chamber at a flow velocity that creates turbulence within the combustion chamber.

The automatically resettable actuator can take the form of a plunger driven by the main spring. The plunger is releasable by a trigger into engagement with the mixing piston for driving the mixing piston in the second direction. Following ignition, combustion pressure separates the plunger from the mixing piston and restores the plunger to its initial latched position. A manual actuator can be used to reset the plunger as a fail-safe mechanism or for an initial cycle of use.

The plunger can also be used as a valve member for controlling discharges from the combustion chamber. For example, the mixing piston can be arranged with a central aperture that can be opened and closed by contact with a valve member formed at the exposed end of the plunger. The central aperture is aligned with a discharge conduit for directing combustion gases from the combustion chamber. Preferably, the discharge conduit directs the combustion gases directly into a barrel for propelling a paintball or directs the combustion gases into pulse-shaping chamber or into pressure-exchanging chamber for further controlling the profile of the pressure pulse reaching the paintball. The size and shape of a seating interface between the central aperture and the valve member end of the plunger as well as the effective area of the plunger exposed to combustion pressure can be adjusted to control the profiles (e.g., as a pressure versus time measurement) of combustion pressure pulses released into the discharge conduit. The central aperture preferably remains closed by the valve member end of the plunger until a desired threshold combustion pressure has been reached sufficient to overcome the biasing force exerted by the plunger. The valve member end of the plunger can be shaped (e.g., as a needle valve plug) to vary the opening size of the central aperture as a function of the retracted position of the plunger for further shaping the profiles of the combustion pressure pulses released into the discharge conduit.

Alternatively, one or more peripheral apertures for releasing combustion gases into a discharge conduit can be located near a closed end of the combustion chamber. The peripheral apertures can be engaged by a mating peripheral surface of the plunger operating as a valve spool for maintaining the peripheral apertures in a closed state until the plunger has retracted to a point near to its initial latched position. The release of combustion pressure pulses is delayed by the further movement of the plunger required to open the peripheral apertures. The further delay in the release of pressure pulses assures more complete burning of the available charge before releasing combustion pressure pulses from the combustion chamber. The burning fuel is consumed before reaching a paintball loaded into the barrel. The size of the opening can be varied as a function of the retracted position of the plunger, such as by varying the shape of the peripheral aperture, for further optimizing the profiles of the combustion pressure pulses released into the discharge conduit.

An automatic loading system for a paintball marker can be arranged to exploit the movement of the mixing piston for loading paintballs in firing position. For example, the discharge conduit coupled to the mixing piston can function as a bolt to alternately admit or block the entrance of paintballs into a breech from a magazine holding a plurality of paintballs. Movement of the mixing piston in the first direction for drawing air into the mixing chamber and displacing exhaust gases from the combustion chamber withdraws the discharge conduit allowing a paintball to enter the breech. Movement of the mixing piston in the second direction for transferring a turbulent charge into the combustion chamber closes the breech and pushes the paintball into the barrel. Accompanying the combustion of the fuel/air charge in the combustion chamber, the discharge conduit conveys the expanding gases in the form of a pressure pulse to the paintball in the barrel for propelling the paintball. In addition, the discharge conduit stores a supply of ambient air, which provides a buffer for the paintball to moderate and cool the combustion gases before the gases reach the paintball.

Alternatively, the discharge conduit can provide a connection between the combustion chamber and the barrel independently of the mixing piston. For example, one or more discharge conduits can be connected to the peripheral surface of the combustion chamber leading to the barrel. A bolt can be connected to the mixing piston for opening and closing the breech and for individually pushing paintballs into the barrel. The discharge conduits preferably connect to the barrel in positions that direct the pressure pulses between the paintballs and the advanced bolt position for launching the paintballs from the barrel.

Although the combustion pressure pulses generated by onboard gas-powered engines preferably propel paintballs directly, the combustion pressure pulses can also be used to drive a pump that converts the combustion pressure pulses into a corresponding pressure pulses transmitted by non-combustion (e.g., ambient) air. The pressure pulses transmitted by ambient air can be compressed within a confined volume of space before being released through a valve into the barrel to apply an enhanced pressure pulse to the paintball. For example, the discharge conduit can direct the combustion gases into a pressure exchange chamber connected to the combustion chamber. Movement of the propulsion piston within the pressure exchange chamber compresses ambient air for shaping the pressure pulses that propel the paintballs.

The pressure exchange chamber can also be associated with a pulse-shaping valve that releases accumulated pressure at a controlled rate.

The engine of the preferred paintball marker generates the combustion-gas-pressure pulses along a central axis aligned with the barrel or along pathways symmetric to the central axis. The mixing piston together with the discharge conduit or bolt reciprocates along the central axis so that the movement of mass within the engine also remains aligned with the central axis. This alignment leads to better balance and a simplified structure.

Although primarily intended as an advance in the art of paintball markers, the invention also has wider applicability to other projectile launchers. Preferably, such launchers include a combustion chamber adapted to receive a charge of fuel and air that is combustible for generating combustion gases and a barrel adapted for receiving the combustion gases for launching projectiles. The combustion chamber is connected to the barrel so that the combustion gases are directed in the form of gas pressure pulses from the combustion chamber into the barrel for propelling the projectiles.

A discharge conduit preferably conveys the gas pressure pulses from the combustion chamber to the barrel. A valve located between the combustion chamber and the discharge conduit allows combustion gas pressure to rise within a confined volume of the combustion chamber before being released into the discharge conduit for generating enhanced pressure pulses for launching the projectiles from the barrel. Preferably, the valve includes a valve member that is moveable between a closed and open position by exposure to the combustion gases.

The preferred launcher also includes a combustion accelerating system for increasing a burn rate of the charge of fuel and air. A displacer redistributes space between a mixing chamber and the combustion chamber. A discharge conduit conveys combustion pressure pulses from the combustion chamber for powering the launch of projectiles. An actuating system relatively moves the displacer in a first direction for expanding the mixing chamber and contracting the combustion chamber and in a second direction for contracting the mixing chamber and expanding the combustion chamber.

The actuating system preferably includes a biasing mechanism that relatively moves the displacer in the first direction for admitting air into the mixing chamber and expelling exhaust gases from the combustion chamber. The actuating system also preferably includes a rechargeable source of potential energy that can be used to move the displacer in the second direction for transferring a charge of fuel and air from the mixing chamber into the combustion chamber. A resettable actuator can be used to recharge the rechargeable source. The resettable actuator can be a manual actuator for manually recharging the rechargeable source or an automatic actuator exposed to combustion pressures within the combustion chamber for recharging the rechargeable source.

The displacer preferably includes a mixing piston that is moveable along an axis of the barrel from which the projectiles are launched. An aperture through the mixing piston allows combustion gases to exit the combustion chamber through the mixing piston along the discharge conduit to the barrel. An ignition timing system can be used to adjust the timing between movement of the displacer and ignition of a charge in the combustion chamber for regulating the output power of each pressure pulse.

An automatic loading system for the launcher preferably incorporates a bolt for alternately admitting and blocking the entrance of projectiles into the barrel from a magazine holding a plurality of projectiles. The bolt preferably moves together with the displacer that redistributes space between the mixing chamber and the combustion chamber. The bolt can be formed by the discharge conduit that conveys the gas pressure pulses from the combustion chamber to the barrel.

A pulse-shaping system preferred for the launcher features a connection between the combustion chamber and the barrel of the launcher for communicating a pressure pulse generated within the combustion chamber to the barrel for launching a projectile. A valve interrupts the connection between the combustion chamber and the barrel for shaping a pressure profile of the pressure pulse before launching the projectile. The combustion chamber preferably includes an exit port and the valve preferably regulates flows of combustion gas through the exit port. The preferred valve is closed at a start of combustion within the combustion chamber and is opened by combustion pressure within the combustion chamber. Two relatively moveable members of the valve provide for varying flow rates through the valve as the valve is opened between fully closed and fully opened positions. Since the paintballs are necessarily somewhat fragile, the ability to shape the pressure-as-a-function-of-time profiles of the combustion-generated pressure pulses assures that the paintballs are safely launched under optimum pressure conditions.

BRIEF DESCRIPTION OF THE SEVERAL VIEWS OF THE DRAWING(S)

Figure 7:
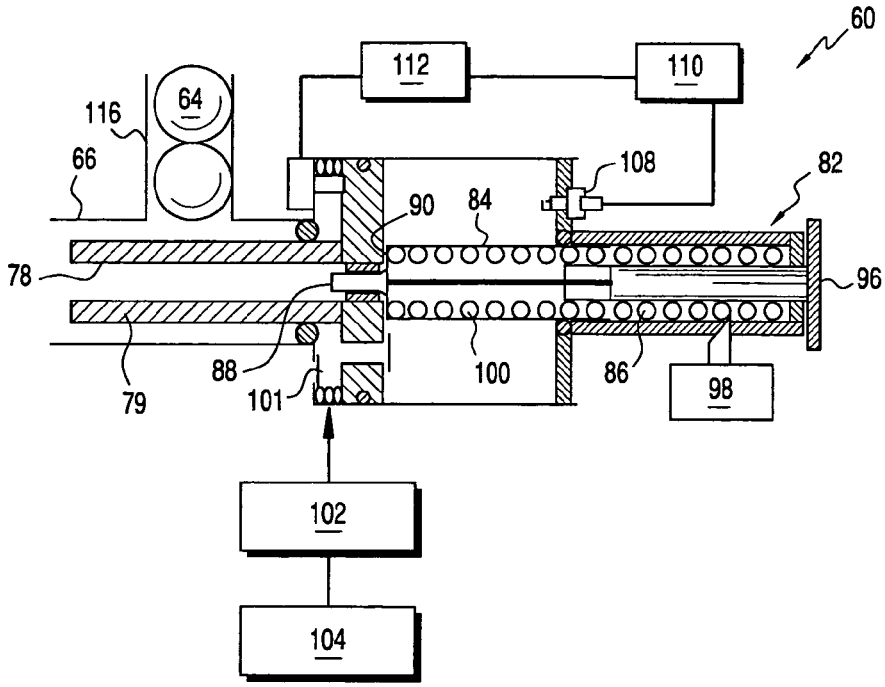
FIG. 7 is a side schematic view of an alternative paintball marker incorporating an actuating system for moving the mixing piston in the second direction linked with a valving system for confining combustion gases within the combustion chamber before releasing the combustion gases into the discharge conduit for generating enhanced pressure pulses for propelling paintballs.
Figure 10:
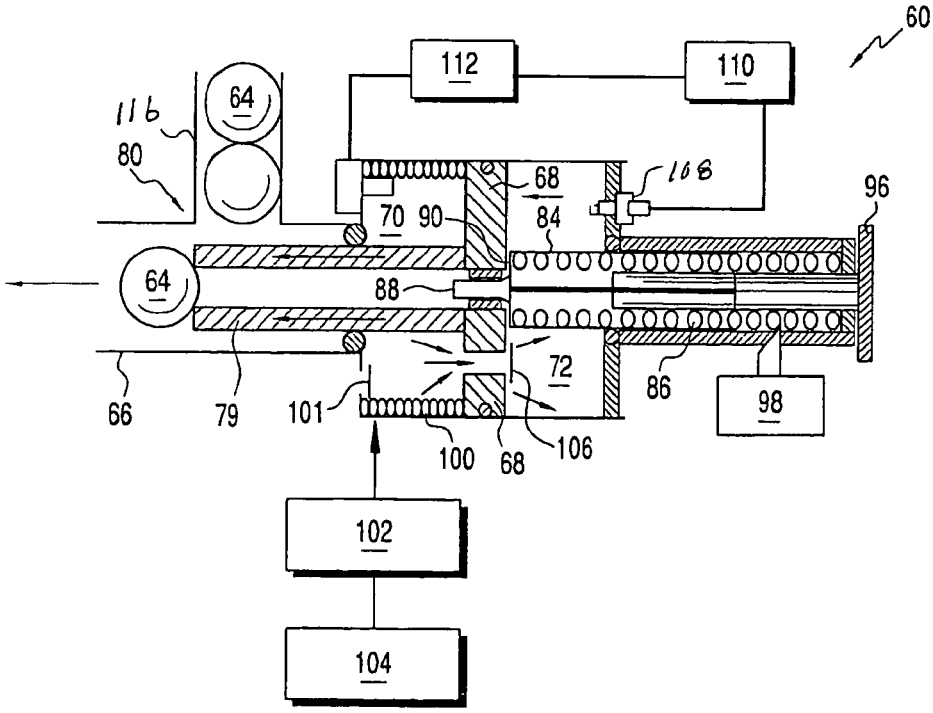

FIG. 10 is a similar cross-sectional side view of the paintball marker of FIG. 7 showing the plunger released from its latched position and driven by a main spring that moves the mixing piston in the second direction for transferring a charge of fuel and air from the mixing chamber into the combustion chamber along with moving a bolt for closing the breach and advancing a paintball into the barrel.

Figure 11:
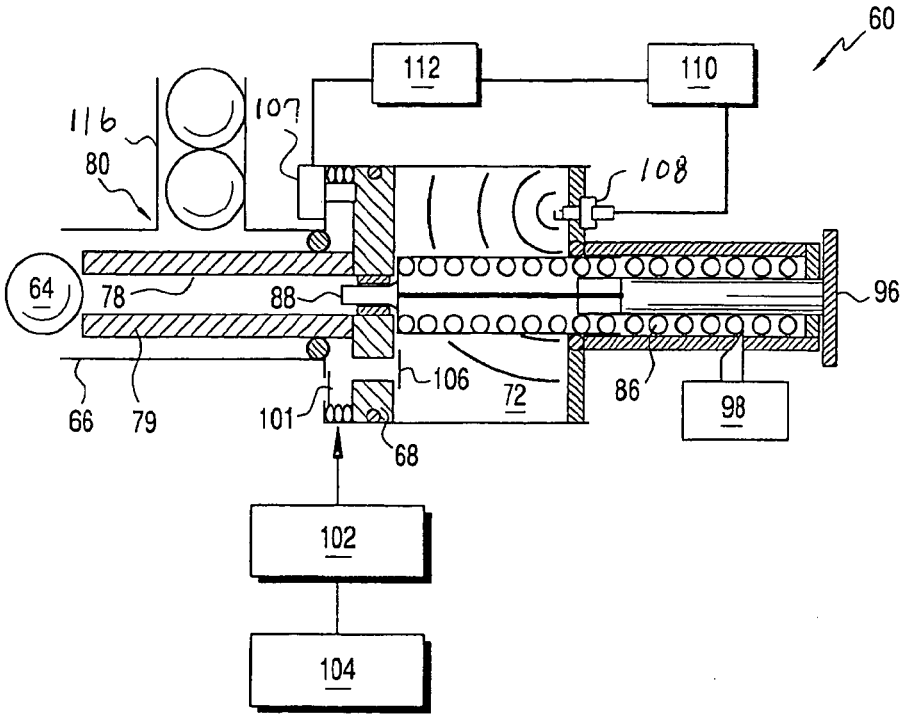

FIG. 11 is a similar schematic side view of the paintball marker of FIG. 7 showing the initiation of combustion within the combustion chamber where a valve member end of the plunger closes an aperture through the mixing piston for allowing combustion gas pressure to rise within the limited volume of the combustion chamber while further advancing the loaded paintball into a launch position.

Figure 12:
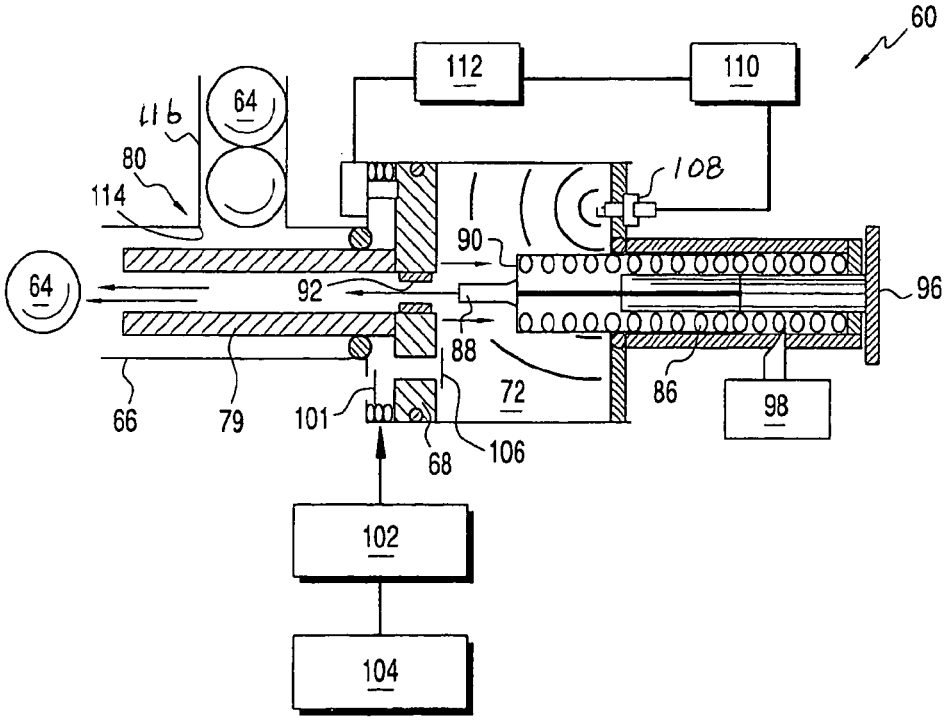

FIG. 12 is a similar cross-sectional side view of the paintball marker of FIG. 7 showing the retraction of the plunger in response to a threshold pressure achieved within the combustion chamber for opening the valve aperture in the mixing piston and allowing a combustion pressure pulse to propagate through a discharge conduit to the loaded paintball.

Figure 13:
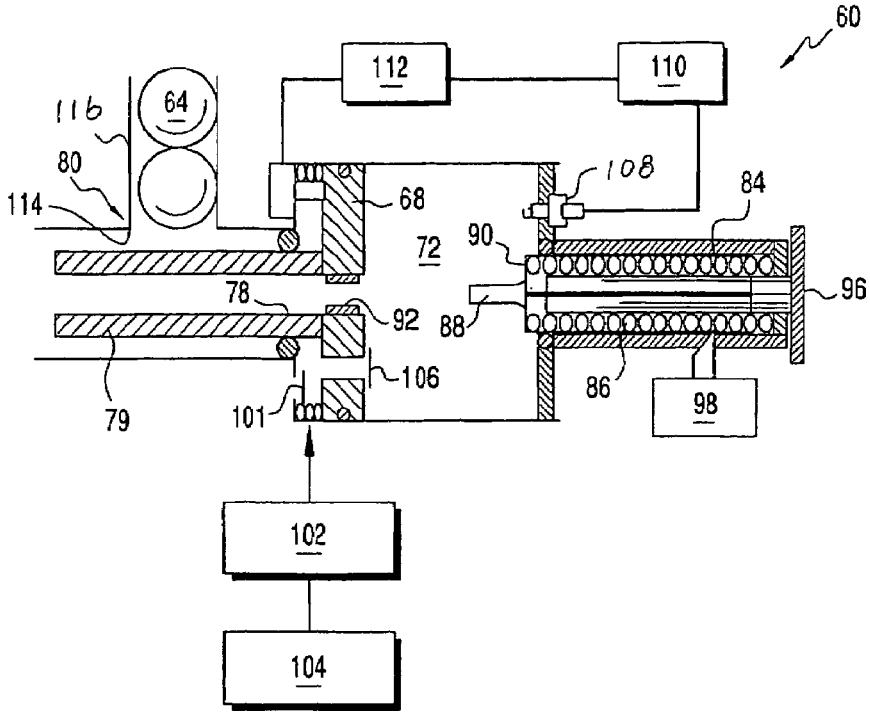

FIG. 13 is a similar schematic side view of the paintball marker of FIG. 7 with the plunger actuator returned to its original latched position while exhaust gases escape from the combustion chamber through the barrel of the paintball marker.

Figure 14:
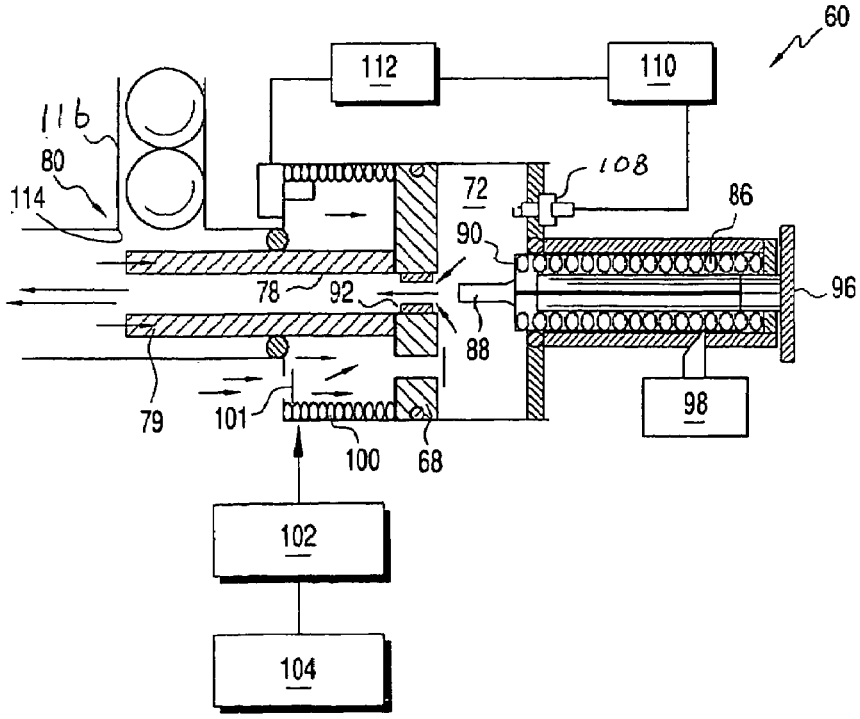

FIG. 14 is a similar schematic view of the paintball marker of FIG. 7 in which a biasing spring moves the mixing piston in the second direction for displacing exhaust gases from the combustion chamber while drawing ambient air into the mixing chamber.

Figure 15:
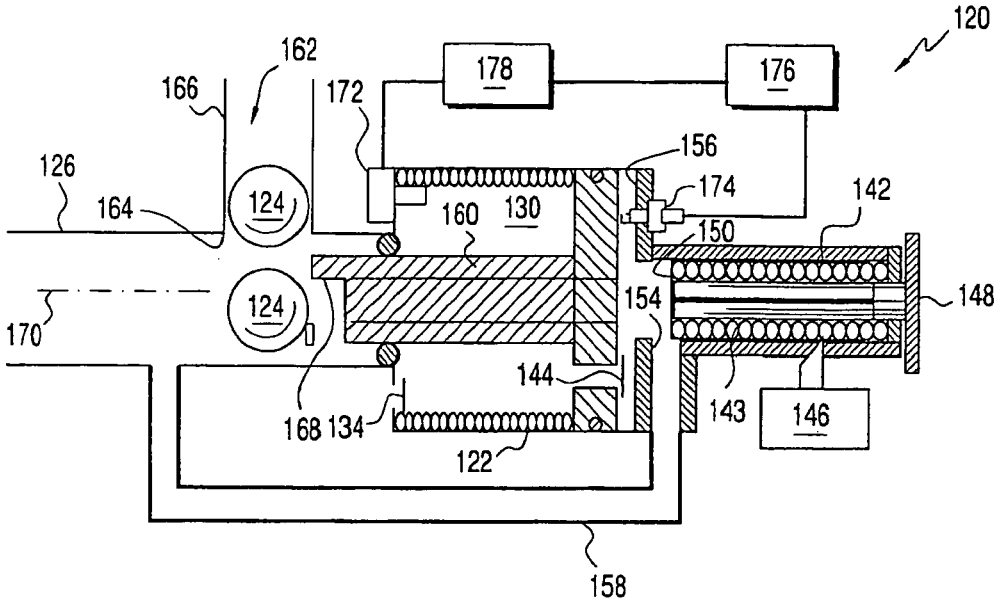

FIG. 15 is a schematic cross-sectional side view of another alternative paintball marker where a bolt coupled to a mixing piston is withdrawn for opening a breach and admitting a paintball from a magazine (ball carrier), a plunger actuator being at its most withdrawn latched position for opening a peripheral passageway through the combustion chamber to a discharge conduit that connects the combustion chamber to the barrel independently of the mixing piston.

Figure 16:
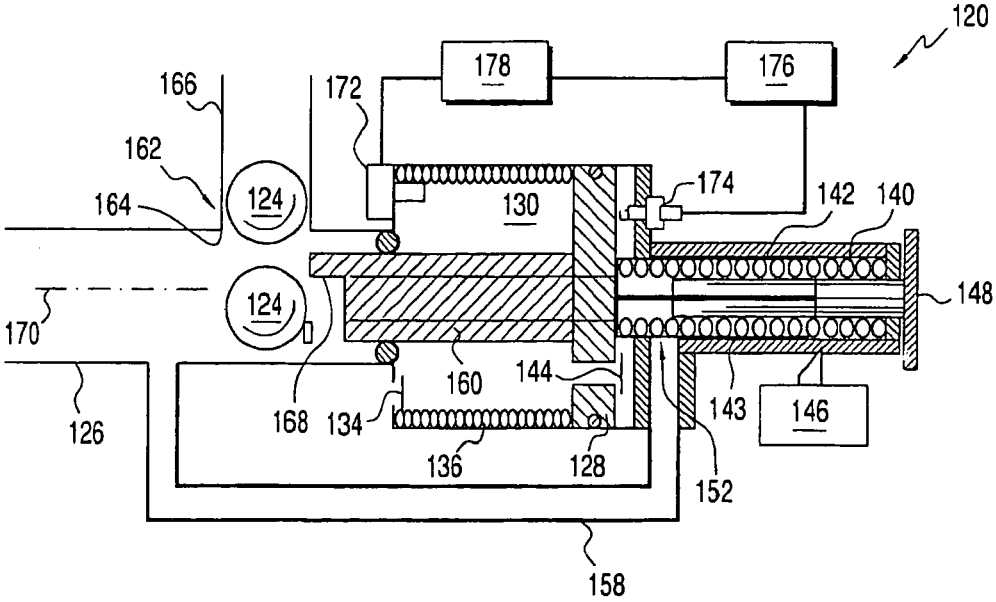

FIG. 16 is a schematic side cross-sectional view of the paintball marker of FIG. 15 in which the plunger actuator is released for closing a valve opening (i.e., an exit port to the discharge conduit) and for engaging the mixing piston for moving the mixing piston in the second direction.

Figure 17:
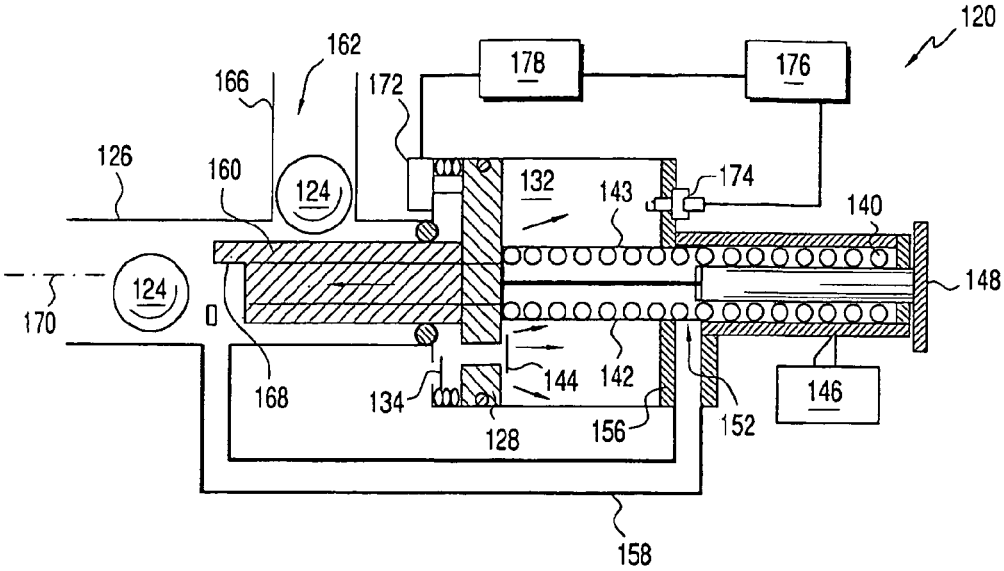

FIG. 17 is a similar schematic side cross-sectional view of the marker of FIG. 15 in which the plunger is fully extended moving the mixing piston into contact with a switch that operates through a delay circuit for initiating ignition within the combustion chamber.

Figure 18:
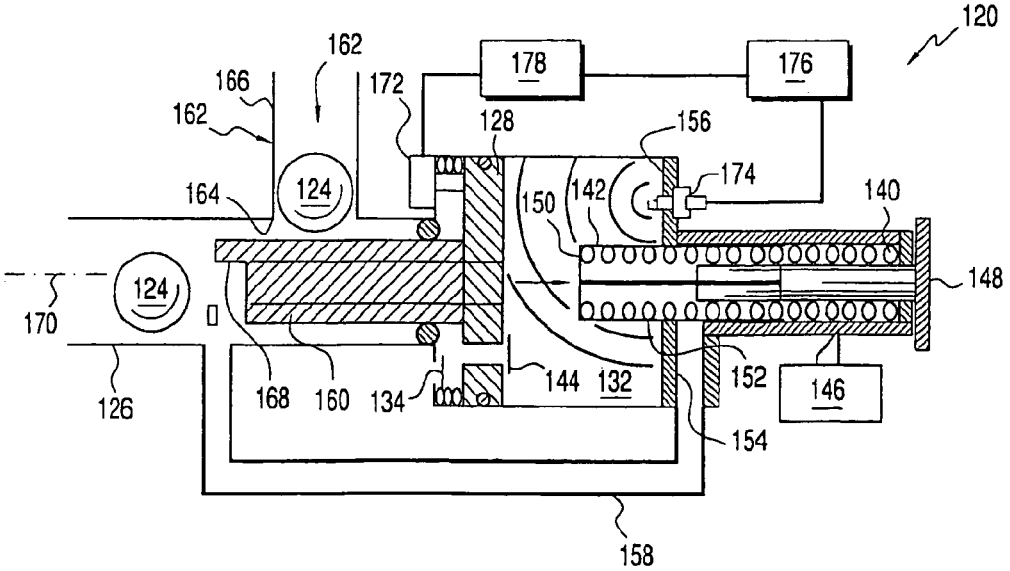

FIG. 18 is a similar side cross-sectional view of the paintball marker of FIG. 15 showing the initiation of combustion, which initiates retraction of the plunger actuator.

Figure 19:
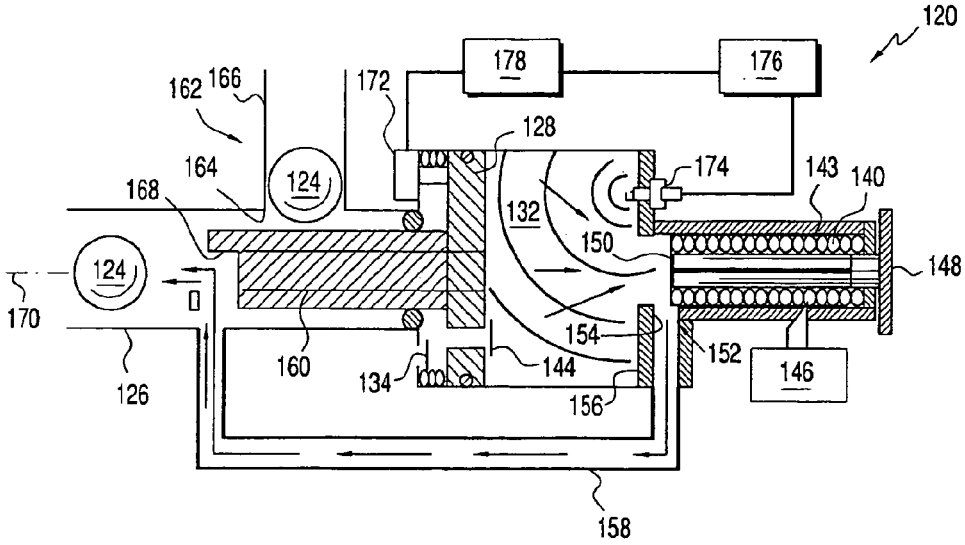

FIG. 19 shows the plunger actuator of FIGS. 15-18 returned to its initial latched position where the exit port from the combustion chamber is opened allowing for the discharge of a combustion-gas-pressure. pulse through a discharge conduit into the barrel for propelling a paintball from the marker.

Figure 20:
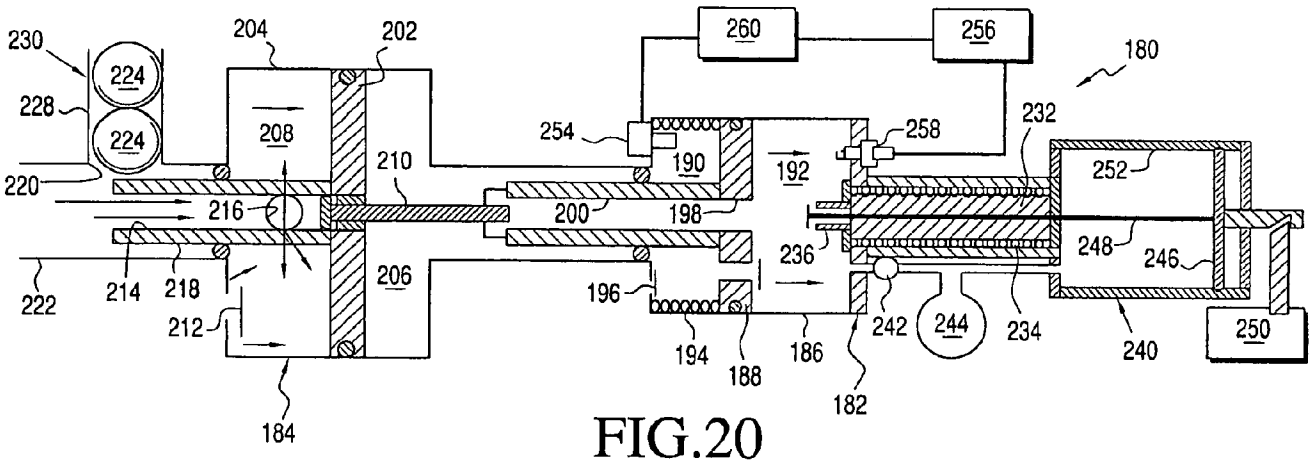

FIG. 20 is a schematic side cross-sectional view of yet another alternative paintball marker showing the combination of a combustion-powered engine with a displacement pump for converting combustion-gas-pressure pulses into corresponding pressure pulses in ambient air.

Figure 21:
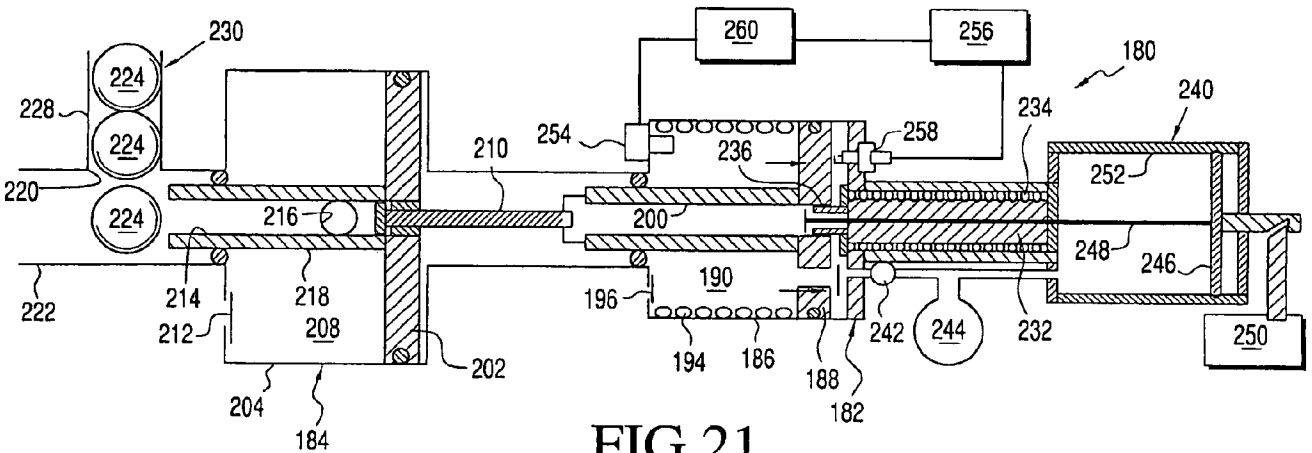

FIG. 21 shows a mixing piston of the combustion-powered engine and a pumping piston of the displacement pump biased to respective starting positions at which ambient air is drawn into both a mixing chamber of the engine and a pumping chamber of the pump. In addition, a bolt movable together with the pumping piston opens a breach for admitting a paintball.

Figure 22:
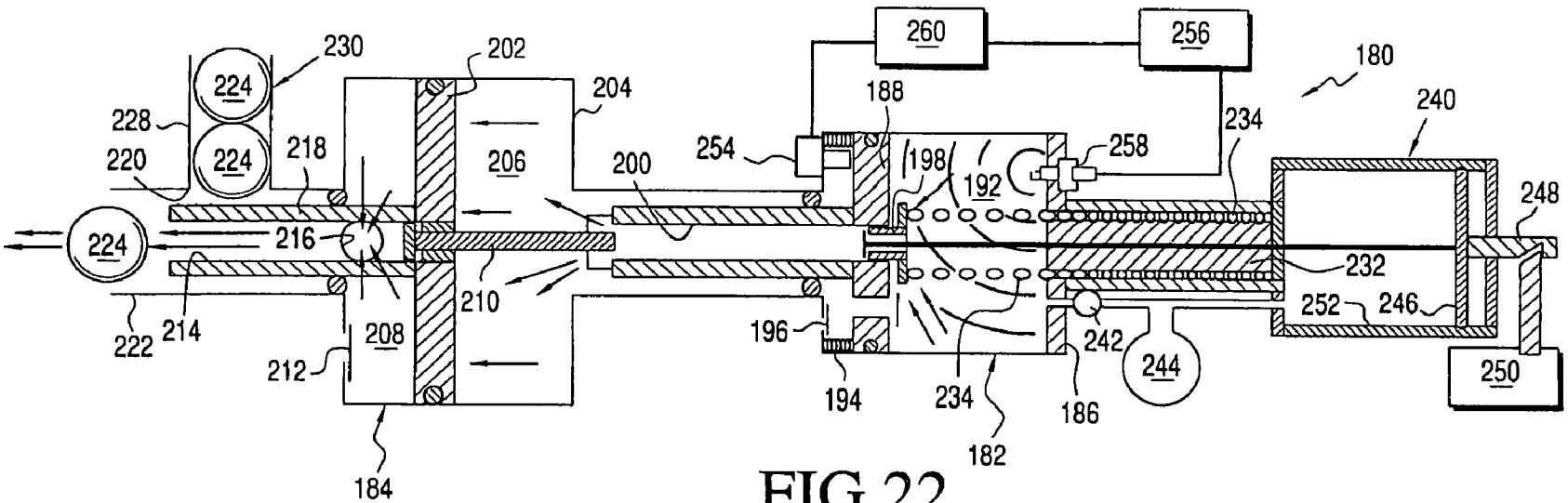

FIG. 22 is a similar side cross-sectional view of the paintball marker of FIG. 20 showing the initiation of combustion within a combustion chamber with combustion gases acting to displace the pump piston for forcing ambient air through a discharge tube into a barrel for propelling a paintball.

Figure 23:
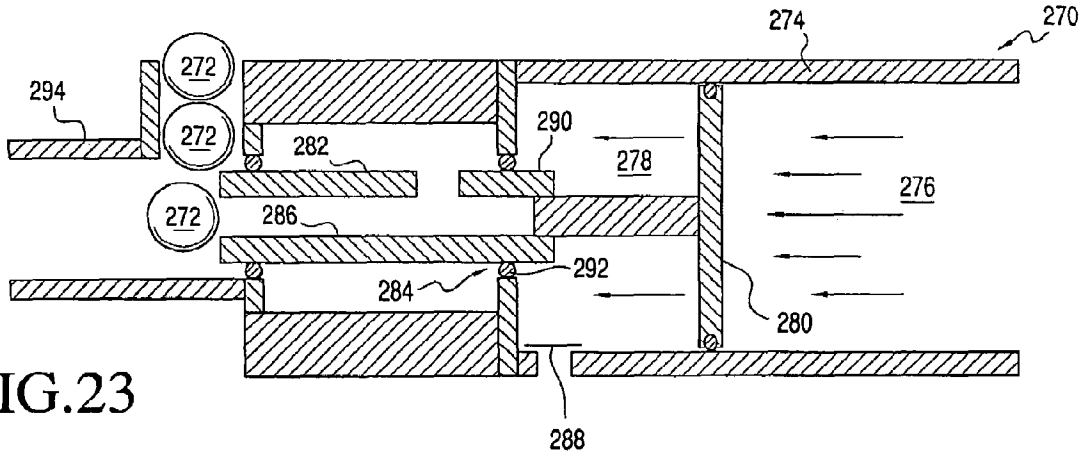

FIG. 23 is a side cross-sectional view of a modified displacement pump for a paintball marker in which a valve between the displacement pump and an air discharge conduit provides for confining ambient air within a pump output chamber prior to its release for shaping a pressure pulse reaching a paintball.

Figure 24:
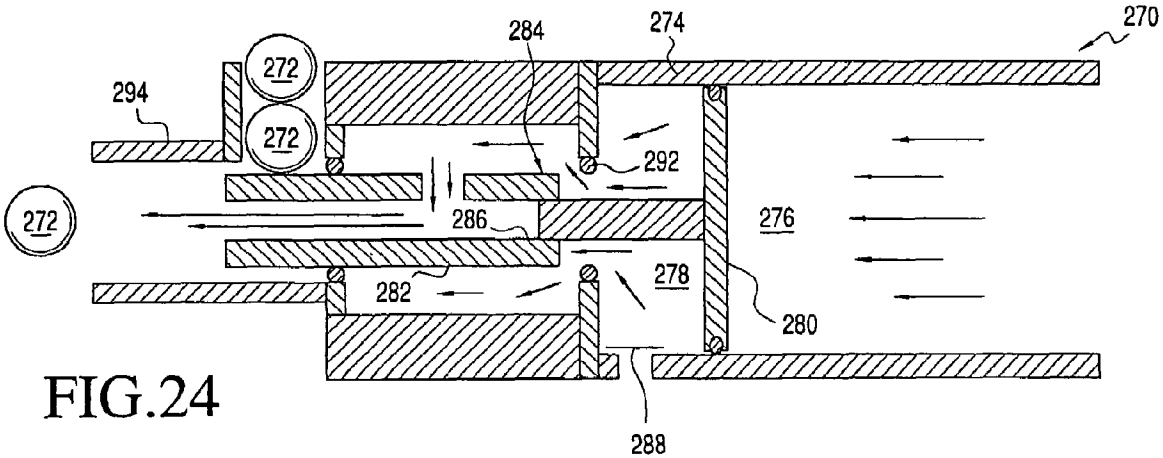

FIG. 24 is a similar side view of the modified displacement pump in which the valve is open for launching a paintball.

DETAILED DESCRIPTION OF THE INVENTION

A paintball marker 10 in accordance with one version of my invention is shown in FIGS. 1 through 6 in which an onboard combustion-gas-powered engine 12 generates combustion-gas-pressure pulses for propelling paintballs 14 from a barrel 16. The engine 12 includes a cylinder head 17 having an interior space that is divided by a displacer in the form of a mixing piston 18 into a mixing chamber 20 and a combustion chamber 22.

Figure 1:
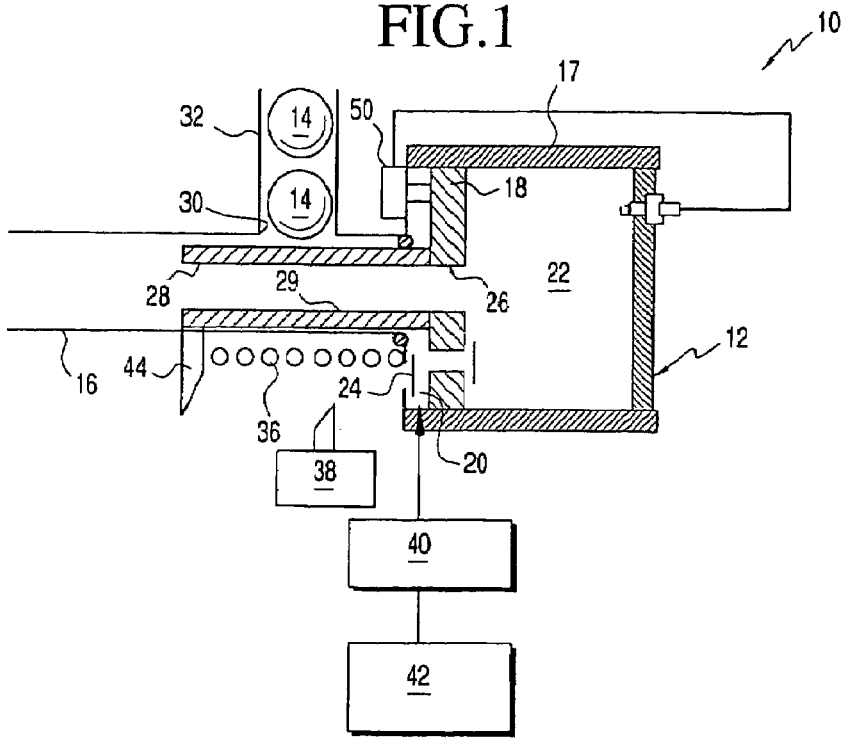
FIG. 1 is a schematic side view of a paintball marker in accordance with my invention, featuring a combustion-gas-powered engine having a combustion accelerating system linked to an automatic loading system.
Figure 2:
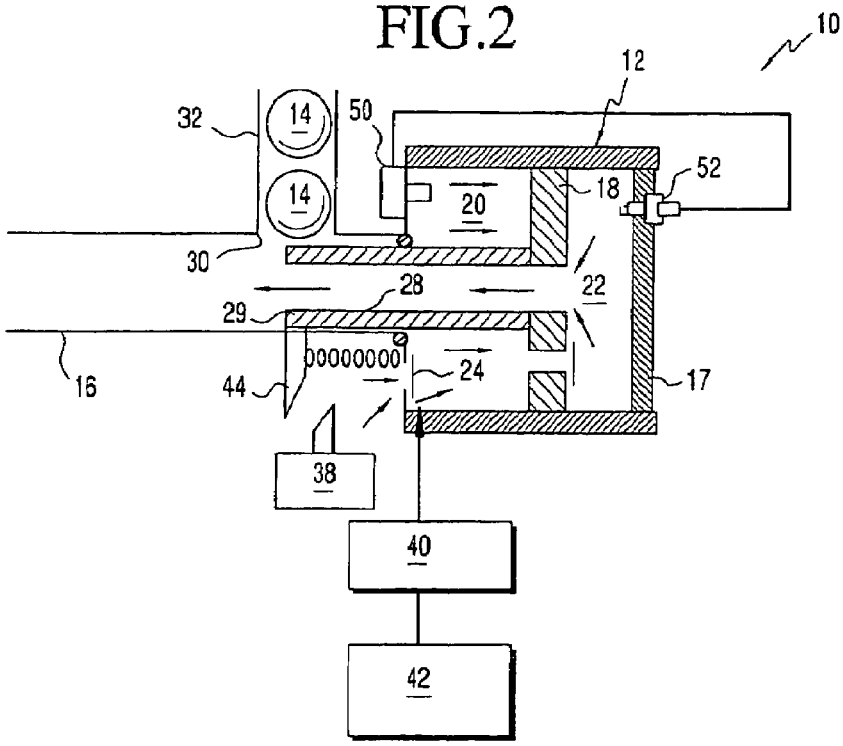
FIG. 2 is a similar schematic view of the paintball marker of FIG. 1 in which a mixing piston of the combustion-accelerating system is moved together with a bolt of the automatic loading system in a first direction that draws air into a mixing chamber and displaces exhaust gases from a combustion chamber.
Figure 3:
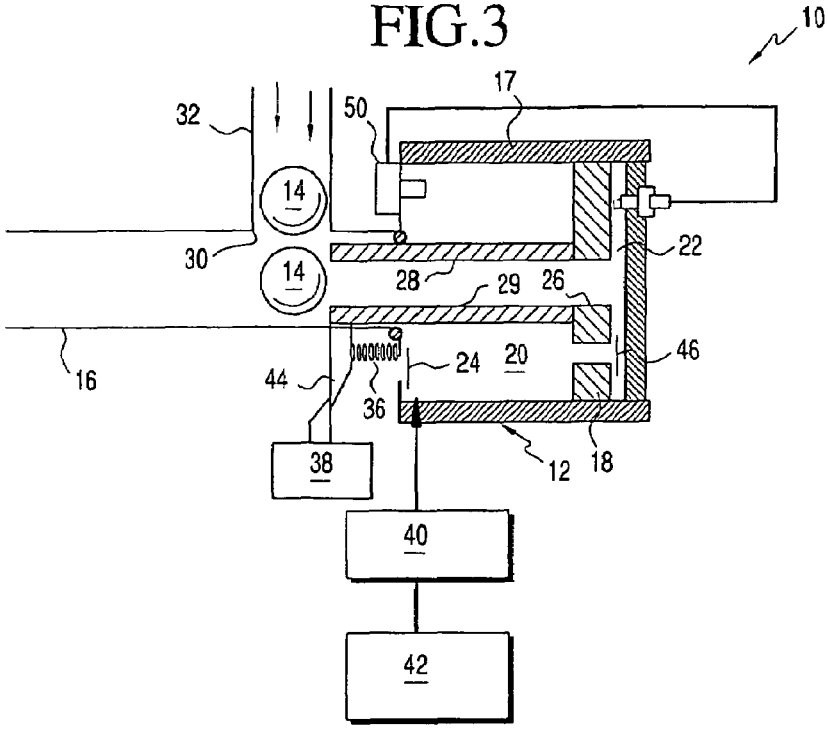
FIG. 3 is a similar view of the paintball marker of FIG. 1 in which the mixing piston is moved to a limit position at which the combustion chamber is at a minimum size, the mixing chamber is at a maximum size, and the bolt is sufficiently withdrawn to open a breach for admitting a paintball from a magazine (ball carrier).

Movement of the mixing piston 18 in a first direction as shown in FIGS. 1 through 3 expands the mixing chamber 20 drawing in ambient air through a check valve 24 into the mixing chamber 20 and contracts the combustion chamber 22 displacing any exhaust gases from the combustion chamber 22 through an exit port 26 in the mixing piston 18. A discharge conduit 28 is connected to the mixing piston 18 in communication with the exit port 26 for conveying the exhaust gases out the barrel 16. The discharge conduit 28 is formed within a bolt 29 whose retraction in the first direction opens a breach 30 for admitting one of a plurality of the paintballs 14 from a magazine 32. The mixing piston 18 together with the bolt 28 is retracted in the first direction against the biasing force of a main spring 36. A trigger latch 38 captures the mixing piston 18 in its most retracted position.

Figure 4:
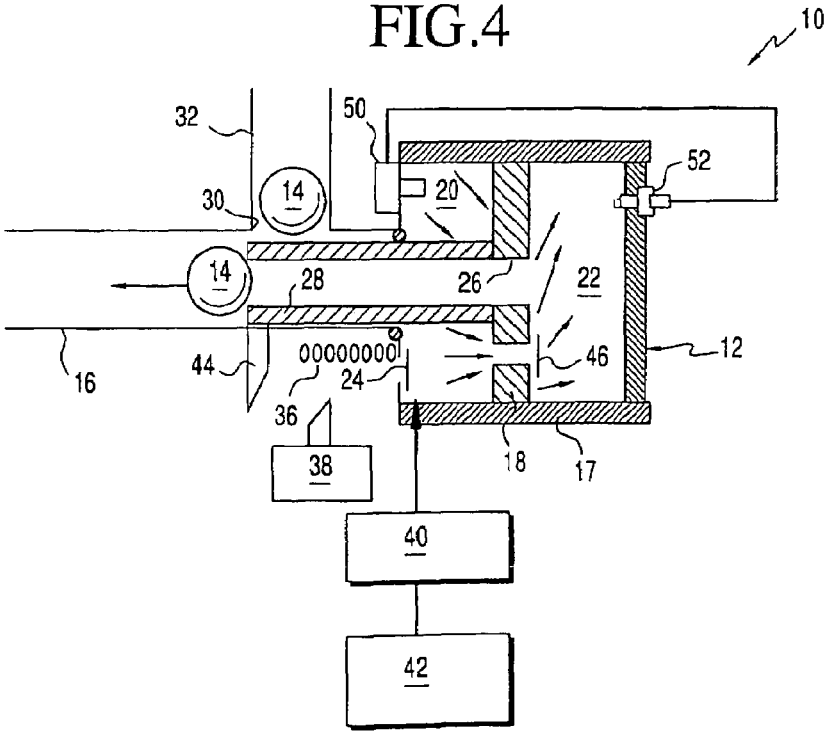
FIG. 4 is a similar schematic view showing movement of the mixing piston in the first direction for transferring a charge of fuel and air from the mixing chamber to the combustion chamber along with the accompanying movement of the bolt for advancing the paintball toward a launch position in a barrel. The bolt is moved toward a position that also closes the breach.

Prior to the release of the mixing piston 18 as shown in FIG. 4, a metered amount of fuel is injected into the mixing chamber 18 from a fuel injector 40. The fuel can be injected accompanying the retraction of the mixing piston 18 in the first direction or after the mixing piston 18 has reached its most retracted position. Fuel can also be injected into the mixing chamber accompanying the release of the mixing piston 18. The fuel is preferably a vapored fuel such as mapp gas, propylene, or propane available from a fuel cartridge 42, which can be attached directly to the paintball marker 10. It is anticipated that as little as 20 grams of such fuel can replace two $CO_2$ containers of conventional paintball markers weighing as much as three pounds each.

A manual actuator 44 can be moved against the biasing force of the main spring 36, which functions as a replenishable power source, for moving the mixing piston 18 together with the bolt 29 in the first direction to the latched position shown in FIG. 3. The trigger latch 38 can be manually engaged for releasing the manual actuator 44 from the latched position for initiating a firing cycle of the paintball marker 10.

As shown in FIG. 4, movement of the mixing piston 18 in a second direction under the influence of the main spring 36 contracts the mixing chamber 20 while expanding the combustion chamber 22 for transferring a charge of fuel and air from the mixing chamber 20 to the combustion chamber 22 through an check valve 46. Preferably, the check valve 46, which also functions as a nozzle, permits fluid flows from the mixing chamber 20 into the combustion chamber 22 but prevents similar flows from the combustion chamber 22 back to the mixing chamber 20. Movement of the bolt 29 together with the mixing piston 18 closes the breach 30 and advances a paintball 14 toward a launching position within the barrel 16.

Figure 5:
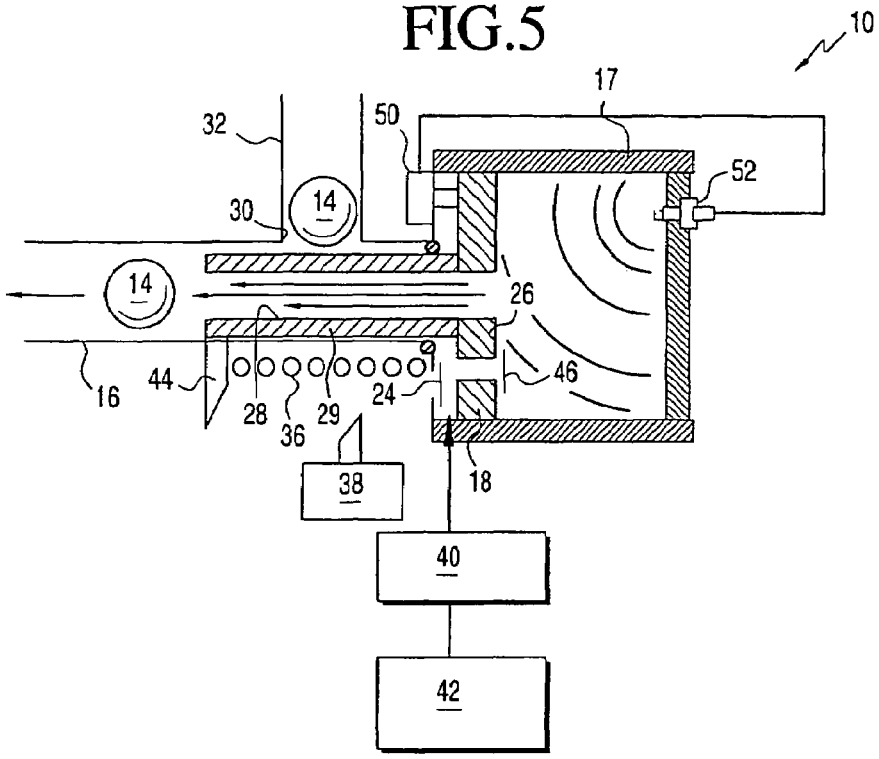
FIG. 5 is a similar schematic view showing combustion initiated by a spark ignition device in the combustion chamber generating combustion pressure for launching the paintball from the barrel.
Figure 6:
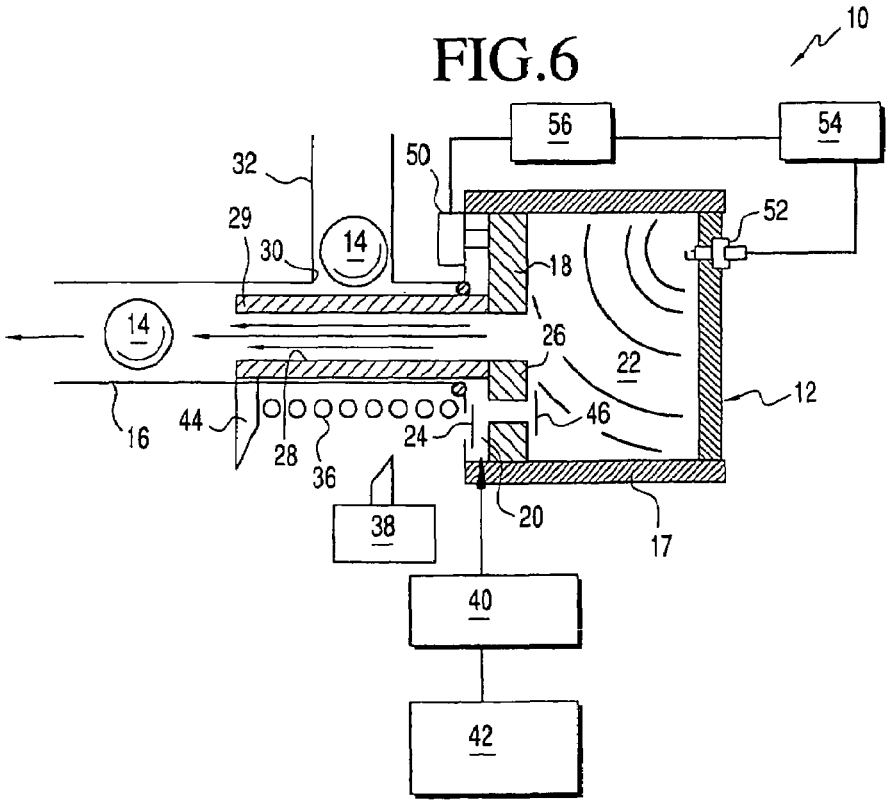
FIG. 6 is a schematic view similar to that of FIG. 5 with the addition of an adjustable delay and electronic ignition circuitry for regulating a timing of combustion within the combustion chamber.

Upon completing the transfer of a spark-ignitable charge into the combustion chamber 22 as show in FIGS. 5 and 6, the mixing piston 18 contacts a switch 50, which initiates ignition by a spark igniter such as the illustrated spark plug 52. The switch 50 can take various forms. For example, the switch 50 can be a piezoelectric sparker, which automatically fires the spark plug 52. Alternatively, the switch 50 can be coupled to an electronic ignition circuit 54 as shown for powering the spark plug 52. An adjustable delay circuit 56 can be used to further adjust the timing between the contact of the switch 50 by the mixing piston 18 and the initiation of ignition by the spark plug 52. The adjustable delay circuit 56 can be set to initiate combustion at a point of peak turbulence of the charge within the combustion chamber 22 or at a point of lesser turbulence to adjust the power output of the engine 12 (which relates to the muzzle velocity of the launched paintball 14).

Expanding combustion gases within the combustion chamber 22 are directed through the exit port 26 in the mixing piston 18 along the discharge conduit 28 to the barrel 16 for launching a paintball 14. Ambient air in the discharge conduit 28 functions as a buffer for cooling the combustion gases before reaching the paintball 14.

A paintball marker 60 shown in various operating stages throughout FIGS. 7 through 14 provides for more automatic operation and for a further shaping of combustion pressure pulses. Similar to the proceeding embodiment, a combustion-gas-powered engine 62 supplies the onboard power for launching paintballs 64 from a barrel 66. A displacer in the form of a mixing piston 68 divides the interior space of a cylinder head 69 between a mixing chamber 70 and a combustion chamber 72. Combustion gases generated within the combustion chamber 72 reach the barrel 66 through an exit port 76 in the mixing piston 68 and along a discharge conduit 78, which is formed within a bolt 79 of an automatic loading system 80.

An actuating system 82, which is shown in a deactivated state in FIG. 7, includes a plunger 84 driven by a main spring 86, which functions as a rechargeable power source. A valve plug 88 projects from an endface 90 of the plunger 84 and engages a valve seat 92 of the exit port 76 forming a needle valve 94 that regulates discharges from the combustion chamber 72. The main spring 86 biases the valve plug 88 into engagement with the valve seat 92, thereby closing the needle valve 94 for restricting flows from the combustion chamber 72.

Figure 8:
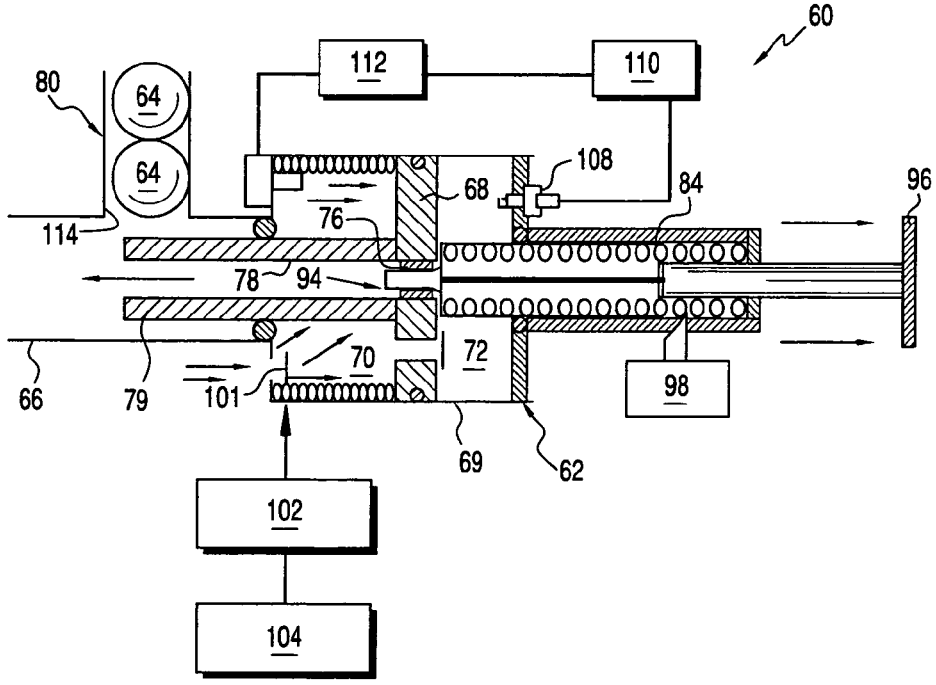
FIG. 8 is a schematic view similar to that of FIG. 7 showing the use of a starter handle for manually retracting a plunger which is accompanied by a similar retraction of the mixing piston for initiating a first operating cycle.
Figure 9:
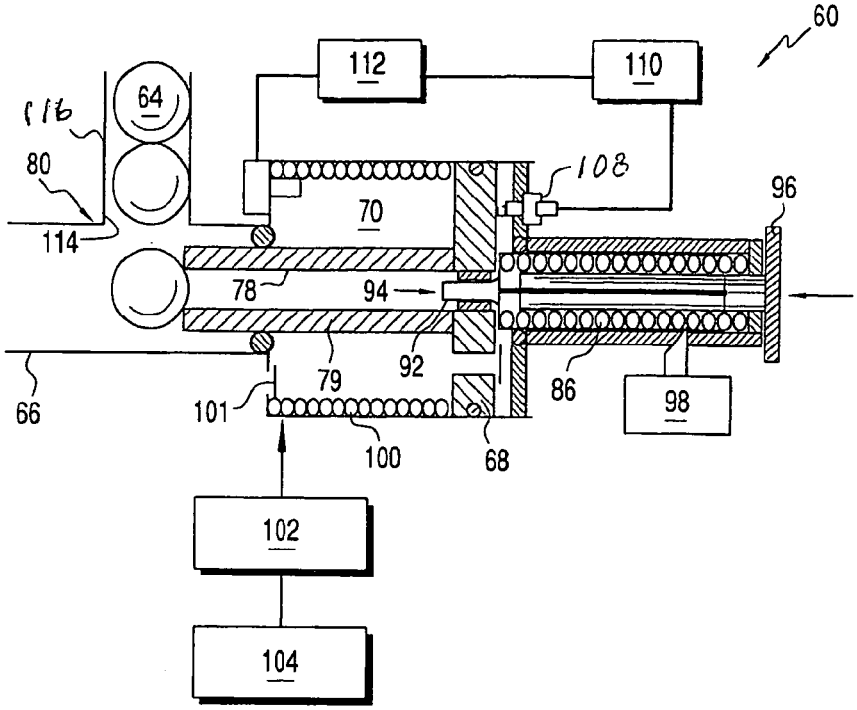
FIG. 9 is a similar schematic view of the paintball marker of FIG. 7 with the plunger actuator returned to an initial latched position and with the mixing piston biased for minimizing the size of the combustion chamber and maximizing the size of the mixing chamber.

A starter handle 96 attached to the plunger 84 can be used to manually retract the plunger as shown in FIG. 8, which progresses to a fully retracted and latched position as shown in FIG. 9. A latch 98 holds the plunger 84 in its retracted position. As also shown in FIGS. 8 and 9, a biasing spring 100 moves the mixing piston 68 in a first direction following the retraction of the stronger main spring 86. Movement of the mixing piston 68 in the first direction contracts the combustion chamber 72 and expands the mixing chamber 70 drawing in a supply of air into the mixing chamber 70 through an intake check valve 101. A fuel injector 102 can be used to inject fuel from an onboard supply 104 into the mixing chamber 70 timed with the movement of the mixing piston 68.

As shown in FIG. 10, release of the plunger 84 from its latched position drives the mixing piston 68 in a second direction for transferring a charge of fuel and air from the contracting mixing chamber 70 into the correspondingly expanding combustion chamber 72. The main spring 86, which functions as a rechargeable power source, overwhelms the biasing spring 100 to move the mixing piston 68 at an optimum rate for creating turbulence within the combustion chamber 72. A check valve 106, which also functions as a nozzle, permits flows from the mixing chamber 70 into the combustion chamber 72 while preventing any backflows into the mixing chamber 70. The needle valve 94 remains closed through the transfer.

As shown beginning in FIG. 11, combustion is initiated in the combustion chamber 72 when the mixing piston 68 contacts a switch 107 approaching the end of its travel in the second direction. Ignition is set off by a spark igniter, such as a spark plug 108 under the control of an ignition circuit 110. Delay circuitry 112 can also be incorporated in to the ignition circuit 110 for adjusting the timing between the contact of the switch 107 and the production of a spark within the combustion chamber 72. The delay can be timed with respect to the peak turbulence created in the combustion chamber 72 for adjusting the power output of the engine 62. The needle valve 94 is biased to a closed position at the start of combustion. However, the endface 90 of the plunger 84 is exposed to combustion pressures within the combustion chamber 72. The needle valve 94 remains closed until a threshold combustion pressure acting over the endface 90 of the plunger 84 is reached that overcomes the bias of the main spring 86 and retracts the plunger 84 as shown in FIG. 12). When the needle valve 94 is opened, the accumulated pressure within the combustion chamber is released through the exit port 76 into the discharge conduit 78 and through the discharge conduit 78 into the barrel 66 for propelling the loaded paintball 64 from the barrel 66.

The valve plug 88 of the needle valve 94 can be shaped with respect to the valve seat 92 to further regulate the release of accumulated combustion gas pressure within the combustion chamber 72. In addition, the size of the plunger endface 90 can be controlled to set a desired threshold pressure within the combustion chamber 72 for first opening the needle valve 94. Profiles (e.g., pressure considered as a function of time) of pressure pulses released from the combustion chamber 72 can be further regulated in such ways. Preferably, the pressure pulses are profiled so that the paintballs 64 are safely expelled from the barrel 66 with limited distortion and desired velocity.

As shown in FIG. 13, combustion pressures generated within the combustion chamber 72 are sufficient to return the plunger 84 to its latched position. In fact, the exit port 76 is sized to sustain enough combustion pressure to reset the plunger 84 to its latched position even when a paintball 64 is not present in the barrel 66. During subsequent exhaust and recharging operations, the exit port 76 remains open, allowing for the escape of exhaust gases out the barrel 66 of the marker 60. When combustion pressures subside as shown in FIG. 14, the biasing spring 100 moves the mixing piston 68 in the first direction for contracting the combustion chamber 72 while correspondingly expanding the mixing chamber 70. The contraction of the combustion chamber 72 by the mixing piston 68 physically displaces exhaust gases from the combustion chamber 72 through the exit port 76 until the mixing piston 68 reaches a limit of its travel in the second direction, which is shown in FIG. 9. There, the needle valve plug 88 re-engages the valve seat 92 for closing the exit port 76 through the mixing piston 68. However, it would also be possible to further relatively retract the plunger 84 or to reshape the needle valve 94 so that the needle valve 94 remains at least partially open in the fully contracted state of the combustion chamber 72.

The automatic loading system 80 exploits the movement of the mixing piston 68 for loading paintball 64 into the barrel 66. As shown in FIG. 9, the bolt 79 moves together with the mixing piston 68 in the first direction for opening a breach 114 and admitting one of the paintballs 64 from a magazine 116. Movement of the bolt 79 together with the mixing piston 68 by the plunger 84 in the second direction closes the breach 114 and advances the loaded paintball 64 into a firing position within the barrel 66.

A paintball marker 120 featuring an alternative connection between a combustion chamber 132 and a barrel 126 is shown in FIGS. 15 through 19. Similar to the proceeding embodiments, the paintball marker 120 includes a cylinder head 122 having an interior space that is divided by a mixing piston 128 into a mixing chamber 130 and the combustion chamber 132. A biasing spring 136 moves the mixing piston 128 in a first direction for admitting air through an intake check valve 134 into the mixing chamber 130. A fuel injector (not shown) can be used to inject fuel from an onboard source into the mixing chamber 132 at the appropriate time. A rechargeable power source in the form of a main spring 140 operates through a plunger 142 for moving the mixing piston 128 in a second direction for transferring the charge of fuel and air from the mixing chamber 130 into a combustion chamber 132 through a check valve 144. The main spring 140 is much stronger than the biasing spring 136 and easily moves the mixing piston 128 in the second direction when both springs 136 and 140 are engaged.

The plunger 142 can be retracted either manually or automatically to a latched position as shown in FIG. 15, which allows the biasing spring 136 to move the mixing piston 128 in the first direction. The plunger 142 can be retracted into engagement with a latch 146 either manually, such as by using a starter handle 148, or automatically, such as by using combustion pressures within the combustion chamber 132. The area of an exposed endface 150 of the plunger 142 can be sized in relation to the mainspring to adjust the combustion pressure required for retracting the plunger 142 to its latched position.

As shown in FIGS. 18 and 19, combustion pressures continue to increase within the combustion chamber 132 until the plunger 142 is retracted nearly to its latched position. A cylindrical side wall 143 of the plunger 142 functions as a spool of a spool valve 152 for closing a corresponding peripheral exit port 154 of the combustion chamber 132. The peripheral exit port 154 is positioned to require the plunger 142 to be retracted beyond the endwall 156 of the cylinder head 122 for opening the exit port 154 and releasing combustion gases from the combustion chamber 132. A discharge conduit 158 connects the exit port 154 to the barrel 126 independently of the mixing piston 128. The requirement for further retracting the plunger 142 to nearly its latched position for opening the exit port 154 assures a more complete burning of the fuel within the combustion chamber 132 before combustion gases are released to the paintball 124. Although a single exit port 154 and a single discharge tube 158 are shown in FIGS. 15 through 19, multiple ports and multiple discharge conduits can be used such as for maintaining a balanced design. For example, the additional exit ports and discharge conduits can be distributed symmetrically around an axis 170 of the barrel 126.

Although discharges from the combustion chamber 132 reach the barrel 126 independently of the mixing piston 128, a bolt 160 is preferably moveable together with the mixing piston 128 to provide an automatic loading system 162 similar to the preceding embodiments. Movement of the bolt 160 together with the mixing piston 128 in the first direction opens a breach 164 for admitting a paintball 124 from a magazine 166. Movement of the mixing piston 128 in the second direction closes the breach 164 and advances the paintball 124 in to a firing position shown in FIGS. 17 through 19. The bolt 160 preferably includes a redirectional end structure 168 that redirects combustion-gas-pressure pulses entering the barrel 126 from the discharge conduit 158 in a direction along the axis 170 of the barrel 126.

Repeated automatic firing of the paintball markers 60 and 120 is made possible by the automatic retraction of their plungers 84 and 142 by using the combustion gas pressures generated during a previous firing cycle. The manual handles 96 and 148 are only required to reinitialize a new firing cycle associated with a first firing or following a misfiring (e.g. lack of fuel) of the paintball markers 60 and 120.

The ignition sequence of the paintball marker 120 is similar to the ignition sequence of the paintball marker 60. However, combustion is allowed to progress further in the paintball marker 120 prior to the allowed release of combustion gases into the barrel 126. The delayed opening of the exit port 154 assures a more complete burning of the fuel within the combustion chamber 132 before the combustion gases are released into the barrel 126.

The firing sequence begins with the release of the latch 146, which allows the plunger 142 to drive the mixing piston 128 in the second direction for transferring a ready charge of fuel and air from the mixing chamber 130 into the combustion chamber 132. Approaching a limit of its travel in the second direction, the mixing piston 128 contacts a switch 172, which initiates an ignition sequence. A spark igniter 174 under the control of ignition circuit 176 produces a spark within the combustion chamber 132 for initiating combustion of the turbulent fuel air mix. Delay circuitry 178 can be combined with the ignition circuitry 176 for adjusting the timing of the spark ignition in relation to the turbulence for adjusting the muzzle velocity of the paintballs 124 launched from the barrel 126.

Individual paintballs 124 entering the breach 164 are first set in motion by the movement of the bolt 160 together with the mixing piston 128, which advances the paintballs 124 into a firing position. The exit port 154 of the combustion chamber 132 remains closed by the side wall 143 of the plunger 142 until the combustion force has returned the plunger 142 to nearly its latched position. Combustion gas pulses released through the spool valve 152 propagate along the discharge conduit 158 and enter the barrel 126 at the redirectional end structure 168 of the bolt 150 for launching the paintballs 124 along the axis 170 of the barrel 126. Since the paintballs 124 are necessarily somewhat fragile, it is preferred that the pressure pulses be shaped to apply pressure to the paintballs 124 in a controlled manner. By adjusting the side wall 143 to exit port 154 interface of the spool valve 152, it is possible to profile the combustion-generated pressure rise time in the barrel 66 to address the requirements of the paintballs 124.

A paintball marker 180 arranged for converting combustion-gas-pressure pulses into pressure pulses in ambient air for launching paintballs is shown in FIGS. 20 through 22. A combustion gas-powered engine 182 is combined with a displacer pump 184 for making the required pressure pulse conversion. Similar to the preceding embodiments, a mixing piston 188 of a combustion accelerating system divides a space within a cylinder head 186 into a mixing chamber 190 and a combustion chamber 192. A bias return spring 194 moves the mixing piston 188 in a first direction for admitting air into the mixing chamber 190 through ah intake valve 196 while displacing any residual exhaust gases from the combustion chamber 192 through an exit port 198.

An engine discharge conduit 200 connected to the exit port 198 conveys expanding combustion gases from the engine 182 to the displacement pump 184. A pump piston 202 within a housing 204 of the displacement pump divides an interior space of the housing 204 into an input chamber 206 and an output chamber 208. The input chamber 206 receives combustion gases from the combustion chamber 192 through the engine discharge conduit 200. A stem 210 connects the pump piston 202 to the mixing piston 188 for movement together in the first direction for contracting the input chamber 206 and correspondingly expanding the output chamber 208. The expansion of the output chamber 208 draws ambient air into the output chamber 208 through an intake valve 212. A pump discharge conduit 214 connects to the output chamber 208 through a pump exit port 216 for directing air from the output chamber 208 into a barrel 222.

Movement of the bolt 218 together with the pump piston 202 and the mixing piston 188 in the first direction under the influence of the bias return spring 194 opens a breach 220 for admitting a paintball 224 from a magazine 228 of an automatic loading system 230. A plunger 232 is biased for moving the mixing piston 188 in a second direction by a main spring 234 or other rechargeable power source. The plunger 232 includes a valve plug 236 that is sized to close the engine exit port 198 when released from its latched position. The plunger 232 can be retracted to its latched position either manually or automatically. For example, an automatic actuator 240 can be used to retract the plunger 232 using excess combustion pressure from the combustion chamber 192. Combustion gases are delivered via a check valve 242 to a plenum accumulator 244. The combustion gases stored in the plenum accumulator 244 are applied to an actuator piston 246 within an actuator cylinder 252. The actuator piston 246 is connected via a stem 248 to the plunger 232, for retracting the plunger 232 to its latched position in engagement with a latch 250. The latch 250 can be attached to a trigger (not shown) for initiating a firing cycle.

Unlatching the stem 248 allows the main spring 234 to drive the plunger 232 into engagement with the mixing piston 188 for moving the mixing piston 188 in the second direction for transferring a charge of fuel and air from the mixing chamber 190 into the combustion chamber 192. Approaching the limit of its travel in the second direction, the mixing piston 188 contacts a switch 254 for initiating an ignition cycle within an ignition circuit 256 that includes a spark igniter 258 for producing a spark within the combustion chamber 192. Delay circuitry 260 can also be incorporated within the ignition circuit 256 to control the timing of the spark ignition with respect to the peak turbulence produced within the combustion chamber 192.

At the start of combustion, the valve plug 236 of the plunger 232 remains seated within the exit port 198 in the mixing piston 188 so that combustion is initiated within a confined volume of the combustion chamber 192. Combustion gases accumulating in the plenum accumulator 244 are directed to the actuator cylinder 252 for driving the actuator piston 246 to retract the plunger 232 and allow combustion gases to escape from the combustion chamber 192 through the discharge conduit 200 into the input chamber 206 of the displacement pump 184. The accumulation of combustion gas pressure within the input chamber 206 drives the pump piston 202 in the second direction for displacing ambient air within the output chamber 208 through the pump exit port 216 into the pump discharge conduit 214 and from there into the barrel 222 for propelling a paintball 224 from the marker 180. Although slightly delayed, the pump piston 202 of the displacer pump 184 follows the movement of the mixing piston 188 of the engine 182 so that the bolt 218 within which the pump discharge conduit 214 is formed can be used for operating the automatic loading system 230.

With reference to FIGS. 23 and 24, an alternative displacement pump for 270 for use in combination with a combustion-gas-powered engine, such as the engine 182 of the preceding embodiment, is arranged for further shaping pressure pulses in ambient air applied to paintballs 272. A pump housing 274 includes an input chamber 276 and an output chamber 278 separated by a pump piston 280. The input chamber 276 communicates with the combustion-gas-powered engine and receives combustion-gas-pressure pulses released from the combustion chamber 192.

Moveable together with the pump piston 280 is a spool 282 of a spool valve 284 that regulates output of the output chamber 278 for shaping pulses transmitted through a pump discharge conduit 286 within the spool 282 for further shaping pressure pulses reaching the paintballs 272. Ambient air enters the output chamber 278 through an intake valve 288 by a movement of the pump piston 280 in a first direction that expands the output chamber 278. Combustion gas pressure drives the pump piston 280 in a second direction that contracts the output chamber 278. The spool 282 engages a surrounding seal 292 of the spool valve 284 for confining ambient air within the output chamber 278 through a portion of the travel of the pump piston 280 in the second direction for pressurizing ambient air within the output chamber 278. However, further movement of the spool 282 together with the pump piston 280 opens the spool valve 284 to allow ambient air to escape the output chamber 278 into a switching chamber 290 and enter the pump discharge conduit 286 for propelling the loaded paintball 272 out a barrel 294. The length and shape of the spool 282 with respect to the surrounding seal 292 can be adjusted for further controlling the profile of pressure pulses reaching the paintball 272.

Although the invention has been described particularly with respect to paintball markers, which are also referred to as paintball guns or paintball launchers, the new propulsion, loading, actuating, pulse shaping, combustion accelerating, and other systems proposed by the present invention can also be applied to other projectile launchers, particularly hand-carried launchers, such as airguns, air soft guns, simunitions, training guns and other gas pulse powered launchers. However, instead of requiring an onboard supply of pressurized gas, my invention provides for using an onboard combustion engine for generating gas pressure pulses. For purposes of simplifying the design, the combustion-gas-pressure pulses generated by the engine are themselves applied for directly launching paintballs or other projectiles. However, the combustion-gas-pressure pulses can be converted by an onboard displacement pump into corresponding pressure pulses in a non-combustion gas such as ambient air before being applied to the projectiles.

The invention claimed is:

1. A method of propelling paintballs from a paintball marker, comprising the steps of:

providing a paintball marker with a barrel for containing a paintball to be propelled from said barrel, and for controlling the direction of propulsion of the paintball when the paintball is propelled out from said barrel;

loading a magazine with a plurality of paintballs, to be individually propelled from said paintball marker, wherein said magazine is operatively connected to said barrel at a breech location through which the plurality of paintballs, within said magazine, may be individually and sequentially introduced from said magazine into said barrel;

positioning a piston within a cylinder head such that said piston is movable within said cylinder head between a retracted position and an extended position, and wherein said piston divides said cylinder head into a mixing chamber, defined upon a first side of said piston, for forming an air-fuel mixture to be combusted, and a combustion chamber, defined upon a second side of said piston, within which said air-fuel mixture is to be combusted;

operatively mounting a first valve within said cylinder head so as to permit air to be ingested into said mixing chamber so as to form part of said air-fuel mixture within said mixing chamber;

operatively associating a fuel injector with said mixing chamber so as to inject fuel into said mixing chamber and thereby form said air-fuel mixture together with said air ingested into said mixing chamber through said first valve;

operatively mounting a second valve upon said piston so as to permit said air-fuel mixture to be conducted from said mixing chamber into said combustion chamber;

disposing ignition means within said combustion chamber for igniting said air-fuel mixture within said combustion chamber;

defining an exit port within said piston; and fixedly connecting a discharge conduit, to said piston such that said discharge conduit is movably disposed within said barrel between a retracted position, for uncovering said breech location of said magazine so as to permit a leading one of the paintballs, disposed within said magazine, to enter said barrel in preparation for propulsion from said barrel, and an extended position for covering said breech location of said magazine so as to prevent other ones of the paintballs, disposed within said magazine, from entering said barrel; and igniting said air-fuel mixture within said combustion chamber so as to initiate firing of said paintball marker and the propulsion of the leading one of the paintballs, disposed within said barrel, out from said barrel as a result of said discharge conduit being fluidically connected to said combustion chamber, through means of said exit port defined within said piston, for conducting combustion products from said combustion chamber into said barrel so as to propel the leading one of the paintballs, disposed within said barrel, out from said barrel.

2. The method of propelling a paintball from a paintball marker as set forth in claim 1, further comprising the steps of:

positioning ignition means within said combustion chamber for igniting said air-fuel mixture within said combustion chamber; and positioning switch means within said mixing chamber of said cylinder head for activating said ignition means so as to initiate combustion of said air-fuel mixture within said combustion chamber, when said piston is moved to said extended position.

3. The method of propelling a paintball from a paintball marker as set forth in claim 2, further comprising the step of:

using a spark plug as said ignition means.

4. The method of propelling a paintball from a paintball marker as set forth in claim 2, further comprising the step of:

interposing an electronic ignition circuit between said switch means and said ignition means so as to activate said ignition means when said switch means is activated.

5. The method of propelling a paintball from a painthall marker as set forth in claim 4, further comprising the step of:

interposing an adjustable delay circuit between said switch means and said electronic ignition circuit for adjustably delaying activation of said ignition means.

6. The method of propelling a paintball from a paintball marker as set forth in claim 2, further comprising the steps of:

positioning a plunger within said cylinder head such that said plunger is movable between a retracted position and an extended position;

mounting valve means upon said plunger for opening and closing said exhaust port defined within said piston when said valve means is respectively unseated from, and seated within, said exhaust port defined within said piston;

using a latch means to operatively engage said plunger so as to releasably retain said plunger, and said valve means mounted upon said plunger, at said retracted position when said latch means is not actuated;

operatively interposing first spring biasing means between said cylinder head and said plunger for moving said plunger, and said valve means mounted upon said plunger, to said extended position so as to cause said piston to move to said extended position and thereby contact said switch means in order to activate said ignition means, when said latch means is actuated so as to release said plunger, so as to initiate combustion of said air-fuel mixture within said combustion chamber;

fixedly connecting a manual actuator to said plunger for moving said plunger, and said valve means mounted upon said plunger, to said retracted position against the biasing force of said first spring biasing means; and operatively interposing second spring biasing means between said cylinder head and said piston for moving said piston and said discharge conduit to said retracted position when said plunger and said valve means, mounted upon said plunger, have been moved to said retracted position by said manual actuator, whereby said valve means, mounted upon said plunger, can be seated within said exhaust port so as to close said exhaust port; and actuating said latch means so as to release said plunger, and said valve means mounted upon said plunger, so as to permit said first spring biasing means to move said plunger, and said valve means mounted upon said plunger, to said extended position so as to cause said piston to move to said extended position and thereby contact said switch means in order to activate said ignition means so as to initiate combustion of said air-fuel mixture within said combustion chamber.

7. The method of propelling a paintball from a paintball marker as set forth in claim 6, further comprising the step of:

providing said plunger with an end face upon which combustion gases within said combustion chamber can act so as to cause said plunger, and said valve means mounted upon said plunger, to be moved toward said retracted position, against the biasing force of said first spring biasing means, whereby said valve means will be unseated from said exhaust port defined within said piston so as to open said exhaust port and thereby permit combustion gases from said combustion chamber to be conducted through said exhaust port and said discharge conduit so as to act upon a paintball, disposed within said barrel, in order to propel the paintball out from said barrel.

8. The method of propelling a paintball from a paintball marker as set forth in claim 7, further comprising the steps of:

permitting said combustion gases, disposed within said combustion chamber and acting upon said end face of said plunger, to initially cause said plunger to be moved to said retracted position at which said plunger will be automatically engaged by said latch means; and after said combustion gases have been exhausted through said exhaust port, defined within said piston, and said discharge conduit so as to propel the paintball, disposed within said barrel, out from said barrel, said second spring biasing means will cause said piston to be moved to said retracted position so as to again permit said valve means, mounted upon said plunger, to be seated within said exhaust port, defined within said piston, whereby said paintball marker is ready to perform a new paintball propelling operation.

9. The method of propelling a paintball from a paintball marker as set forth in claim 7, further comprising the step of:

providing said end face of said plunger with predetermined size dimensions so as to predetermine the threshold pressure of said combustion gases within said combustion chamber at which said plunger and said valve means, mounted upon said plunger, will be moved toward said retracted position, against the biasing force of said first spring biasing means, so as to permit said valve means to be unseated from said exhaust port defined within said piston so as to open said exhaust port and thereby permit combustion gases from said combustion chamber to be conducted through said exit port and through said discharge conduit so as to act upon a paintball, disposed within said barrel, in order to propel the paintball out from said barrel.

10. The method of propelling a paintball from a paintball marker as set forth in claim 6, further comprising the step of:

providing said valve means with a predetermined configuration with respect to said exhaust port, defined within said piston, so as to control the flow of said exhaust gases from said combustion chamber through said exhaust port, defined within said piston, and into said discharge conduit and said barrel.

* * * * *